US005931175A

United States Patent [19]

Lin et al.

[11] Patent Number: 5,931,175

[45] Date of Patent: Aug. 3, 1999

[54] UMBRELLA RIB ASSEMBLY HAVING LIGHT GROOVED RIB REINFORCED WITH RESILIENT RIB

[75] Inventors: Chung-Kuang Lin; Jung-Jen Chang, both of Taipei Hsien, Taiwan

[73] Assignee: Fu Tai Umbrella Works, Ltd., Taipei, Taiwan

[21] Appl. No.: 09/001,515

[22] Filed: Dec. 31, 1997

[30] Foreign Application Priority Data

Aug. 14, 1997 [TW] Taiwan ..... 86213855

[51] Int. Cl.[6] ..... A47B 19/10

[52] U.S. Cl. ..... 135/31; 135/25.1; 135/25.32; 135/29; 135/32

[58] Field of Search ..... 135/25.1, 25.32, 135/25.31, 29, 31, 32

[56] References Cited

U.S. PATENT DOCUMENTS

| | | | |
|---|---|---|---|
| 192,496 | 6/1877 | Falcina . | |
| 360,966 | 4/1887 | Lecraft . | |
| 432,324 | 7/1890 | Mussen . | |
| 435,735 | 9/1890 | Dill . | |
| 473,649 | 4/1892 | Whitcomb . | |
| 886,426 | 5/1908 | Shivers . | |
| 1,268,283 | 6/1918 | Rudolph . | |
| 1,728,489 | 9/1929 | Hanson . | |
| 2,160,231 | 5/1939 | Schaefer | 135/26 |
| 2,221,289 | 11/1940 | Okun . | |
| 2,336,116 | 12/1943 | Morando . | |
| 2,385,575 | 9/1945 | Isler . | |
| 2,670,133 | 2/1954 | Volker . | |
| 2,889,841 | 6/1959 | Kampf . | |
| 3,252,468 | 5/1966 | Militano . | |
| 5,121,764 | 6/1992 | Wu . | |

*Primary Examiner*—Carl D. Friedman
*Assistant Examiner*—Phi Dieu Tran A

[57] ABSTRACT

An umbrella rib assembly includes: a top rib having a cross section of U shape and made of light material including aluminum alloy, an outer rib having a cross section of circular shape and made of composite or plastic materials having good resilience and mechanical strength to be connected at an outer end of the top rib, and a stretcher rib pivotally connected with the top rib, thereby providing an umbrella having light weight but having suitable resilience and strength.

3 Claims, 7 Drawing Sheets

1
2
3
4
11
12
21
22
110
111
112
113
114
211

1
104
10
11
102
101
2
12
21
4
41
103
13
1
11
102
101
12
41

104
102
10
101
104
103

10
21
103
4
2
42
22
3

UMBRELLA RIB ASSEMBLY HAVING LIGHT GROOVED RIB REINFORCED WITH RESILIENT RIB

BACKGROUND OF THE INVENTION

A conventional umbrella includes a top rib having a cross section of U shape for pivotally connecting a stretcher rib. The U-shaped top rib is generally made of steel material to increase the total weight of the umbrella, thereby being heavy and inconvenient for carrying. Some umbrella ribs are made of steel material to have a cross section of circular or "O" shape of the rib, still being heavy in weight and inconvenient for carrying.

If the umbrella ribs are made of light materials such as aluminum alloy, the umbrella weight can be reduced for convenient carrying. However, the aluminum ribs are lacking of resilience and can not well resist the deformation, twisting or bending of the ribs.

The present inventor has found the drawbacks of the conventional umbrella ribs and invented the present rib assembly having light grooved rib reinforced with resilient rib.

SUMMARY OF THE INVENTION

The object of the present invention is to provide an umbrella rib assembly including: a top rib having a cross section of U shape and made of light material including aluminum alloy, an outer rib having a cross section of circular shape and made of composite or plastic materials having good resilience and mechanical strength to be connected at an outer end of the top rib, and a stretcher rib pivotally connected with the top rib, thereby providing an umbrella having light weight but having suitable resilience and strength.

DETAILED DESCRIPTION

Figure 1:
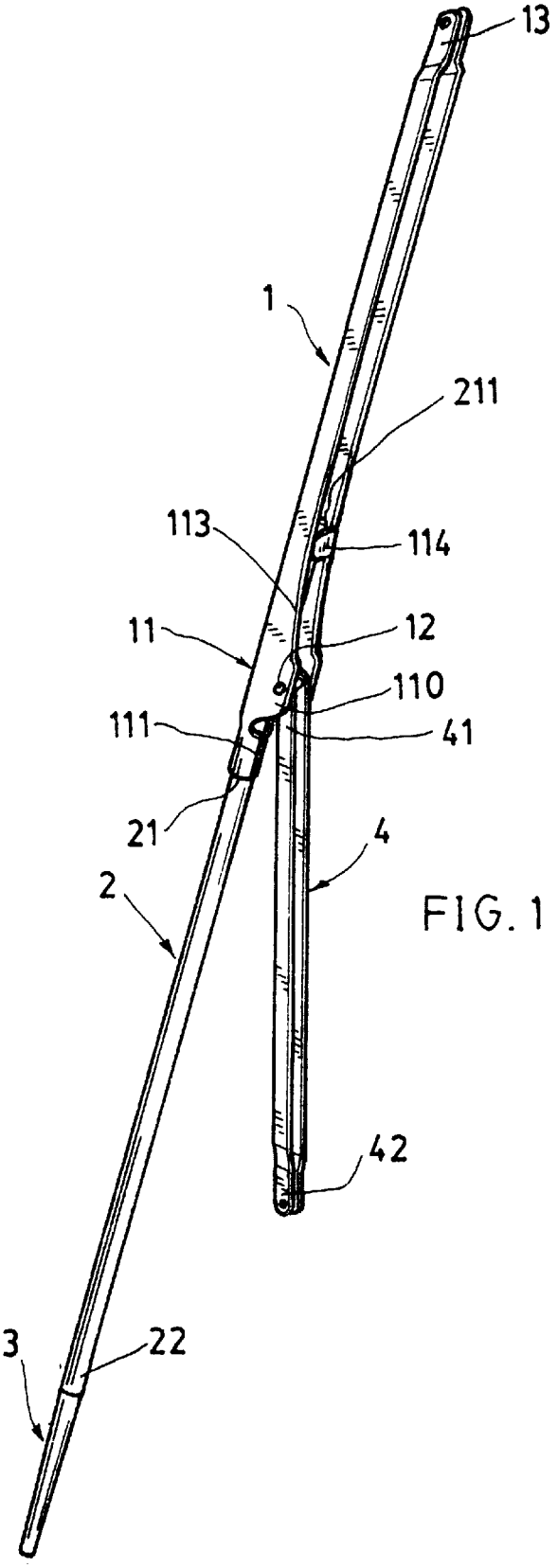
FIG. 1 is a perspective view of the present invention.

As shown in FIGS. 1–6, the present invention comprises: a top rib 1 having a cross section of U shape or the like shape, an outer rib 2 having a cross section of circular shape or the like shape and connected to the top rib 1, and a tapered rib tip 3 formed at or connected with an outer end of the outer rib 2, and a stretcher rib 4 pivotally connected to the top rib 1 adjacent to a joint between the top rib 1 and the outer rib 2. The top rib 1 may also be designated as "main rib"; while the stretcher rib 4 may also be designated as "lower supporting rib", not limited. The present invention may also be modified to be multiple folds such as two folds or triple folds of an umbrella, not limited in this invention.

The top rib 1 may be made of light materials including aluminum alloy, titanium alloy, and other materials light in weight, suitable for mechanical processing, extrusion, pressing, compression and integral forming for making an U-shaped groove longitudinally recessed in the top rib 1.

The outer rib 2 may be made of composites or plastic materials having properties such as good mechanical strength for resisting bending, deformation, or twisting and having suitable resilience. The materials for making the outer rib 2 may be selected from the group consisting of: carbon fiber, fiber-glass reinforced plastic, nylon, mineral-fiber reinforced composites, and the other reinforced composites, elastomers or engineering plastics.

The top rib 1 includes an outer portion 11 having an outermost end portion 111 which is bifurcated to be two crimping lugs for cladding, surrounding or compressing an inner portion 21 of the outer rib 2, having a plurality of prongs, teeth, or protrusions 112 pressed inwardly from the top rib 1 into the inner portion 21 of the outer rib for firmly bonding the inner portion 21 of the outer rib 2 with the outer portion 11 of the top rib 1.

The outer rib 2 has its outer end portion 22 connected with a tapered rib tip 3 which may be made of the same composite or plastic material as used for making the outer rib 2. The tapered rib tip 3 may be connected with a ball tip 30 (FIG. 5) or the rib tip 3 may be directly formed as a ball tip 30.

Figure 15:
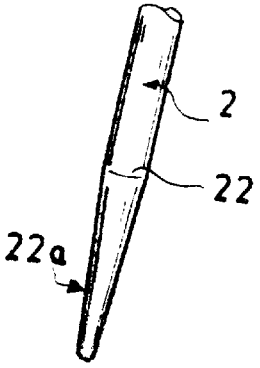
FIG. 15 shows another preferred tapered rib tip of the present invention.
Figures 2, 3, 4:
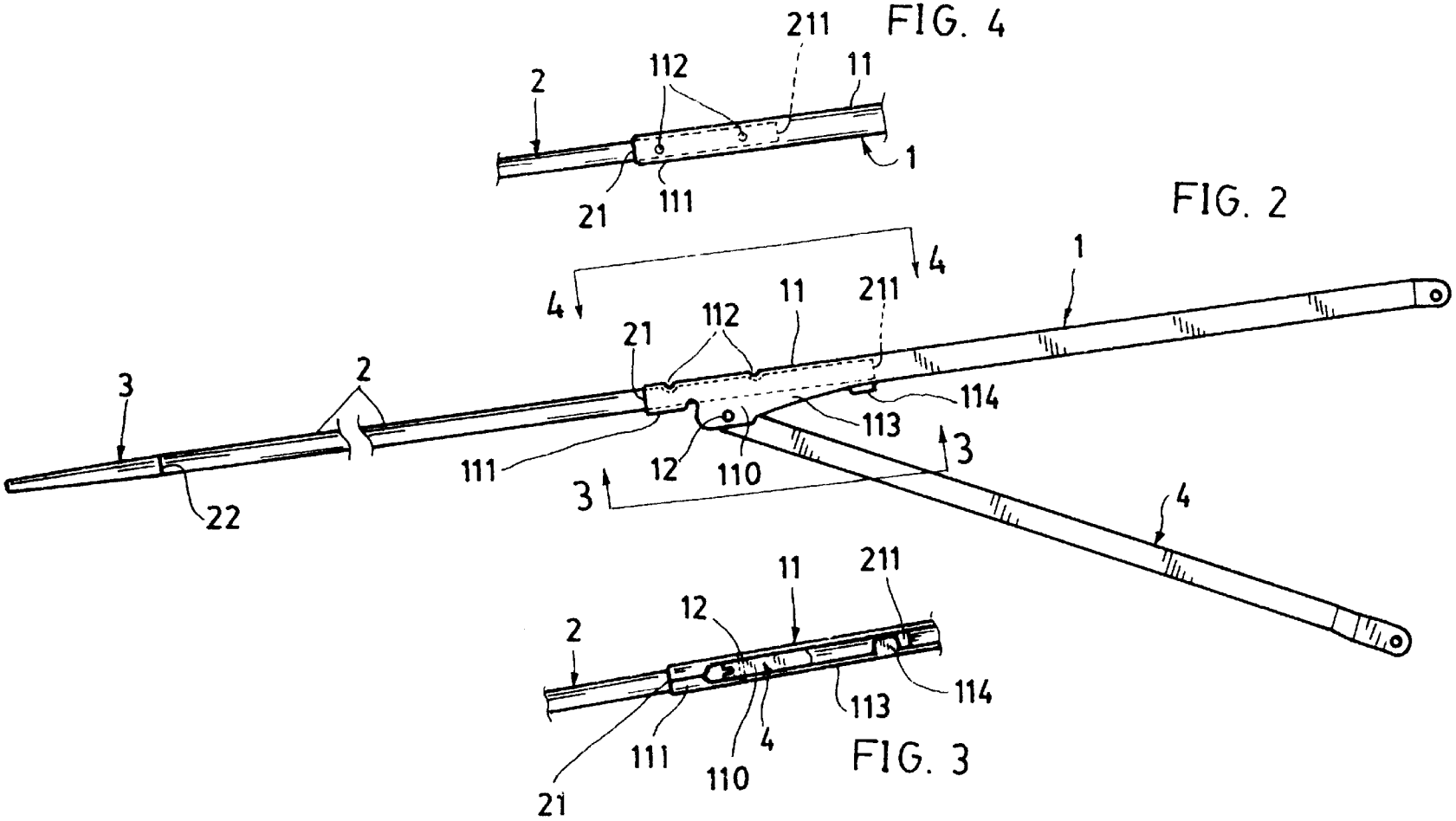
FIG. 2 is a front view of the rib assembly of the present invention.
FIG. 3 is a bottom view of the rib assembly as viewed from 3—3 direction of FIG. 2.
FIG. 4 is a top view of the rib assembly as viewed from 4—4 direction of FIG. 2.

The outer rib 2 may be processed or formed with the tapered rib tip 3 directly on an outer end of the rib 2 for making a slim umbrella rib assembly (FIG. 15) which may be folded towards the central shaft 5 as close as possible when the umbrella is closed.

Figure 5:
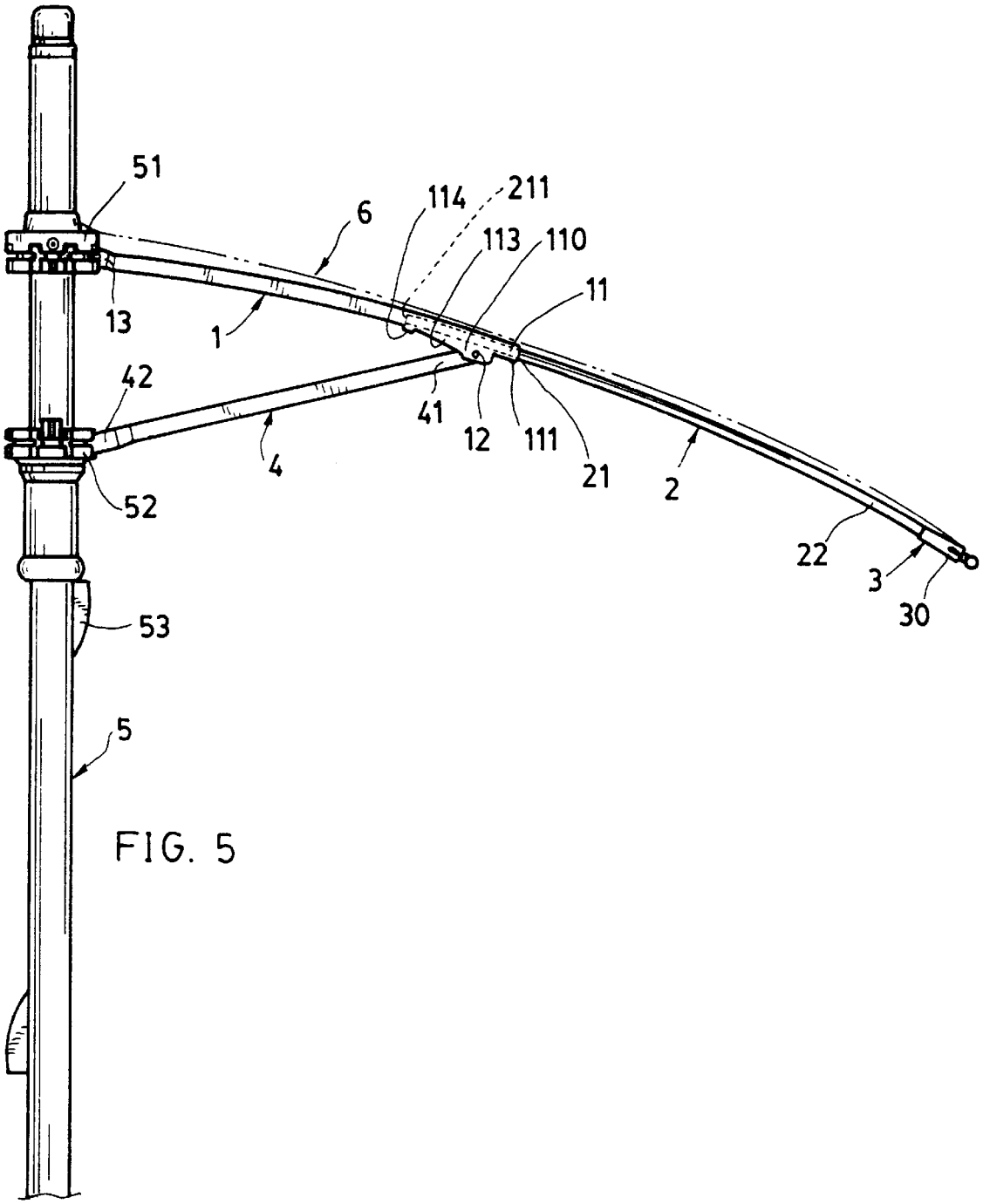
FIG. 5 is an illustration showing an opening umbrella of the present invention.
Figure 6:
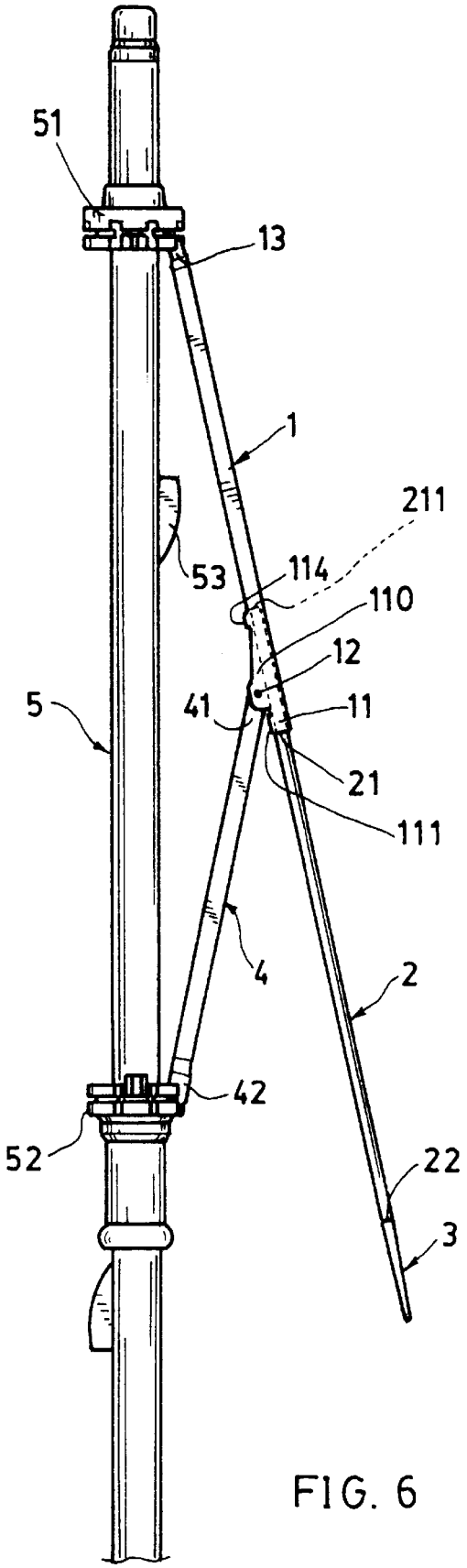
FIG. 6 shows a folded umbrella.

As shown in FIGS. 5, 6, the top rib 1 has its outer portion 11 formed with a pair of protrusion lugs 110 pivotally connected with an outer rib portion 41 of the stretcher rib 4 by a pivot 12; an inner end portion 13 of the top rib 1 pivotally secured to an upper notch 51 formed on a top portion of the central shaft 5. The stretcher rib 4 has its inner rib portion 42 pivotally connected to a runner 52 slidably held on the central shaft 5, whereby upon opening of the umbrella, the runner 52 will be stopped against a catch 53 formed on the shaft 5 while the umbrella cloth 6 is extended by the rib assembly as shown in FIG. 5. Each protrusion lug 110 is tapered inwardly towards a middle portion of the top rib 1 for forming a reinforcing wing portion 113 between the lug 110 and the top rib 1, having a bottom extension 114 bent from a reinforcing wing portion 113 to be positioned at a bottom of the top rib 1 for cladding and limiting an innermost end 211 of the outer rib 2.

Figures 7, 8, 9:
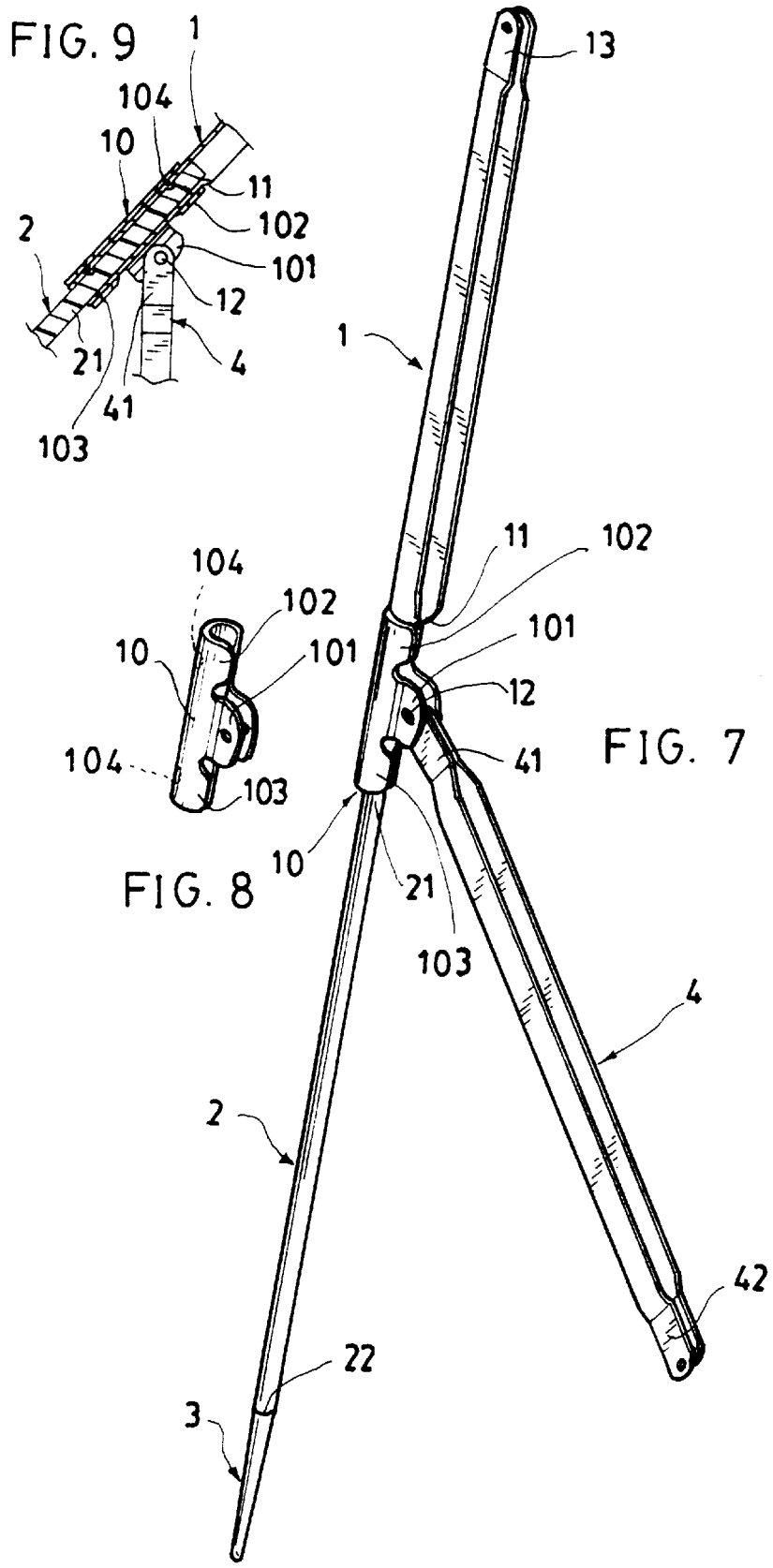
FIG. 7 shows another preferred embodiment of the present invention.
FIG. 8 is a perspective view of the joint member of the present invention.
FIG. 9 is a partial sectional drawing of the rib assembly of the present invention.

As shown in FIGS. 7–9, the top rib 1 has its outer portion 11 cladding or surrounding the inner portion 21 of the outer rib 2, and a joint member 10 disposed around a junction between the top rib 1 and the outer rib 2. The joint member 10 includes: a pair of protrusion lugs 101 for pivotally connecting an outer rib portion 41 of the stretcher rib 4 by a pivot 12, two pairs of crimping lugs 102, 103 disposed on opposite sides of the protrusion lugs 101 for cladding the outer portion 11 of the top rib 1 in which the inner portion 21 of the outer rib 2 has been clad in the outer portion 11 of the top rib 1 , and a plurality of prongs, teeth or protrusions 104 pressed inwardly from the joint member 10 into the outer portion 11 of the top rib 1 and the inner portion 21 of the outer rib 2 for bonding the joint member 10, the outer rib 2, and the top rib 1 all together.

Figure 11:
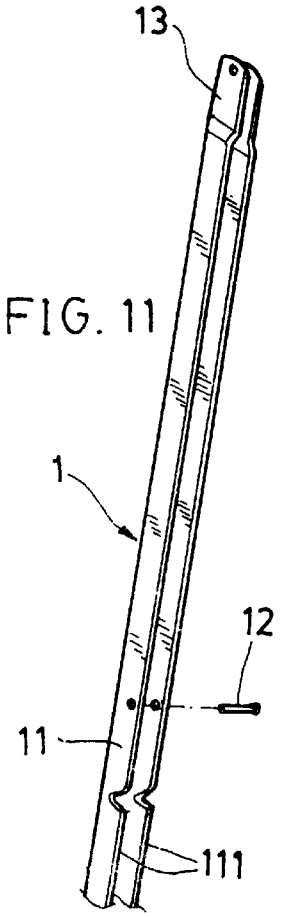
FIG. 11 shows a perspective view of the top rib of FIG. 10.
Figure 10:
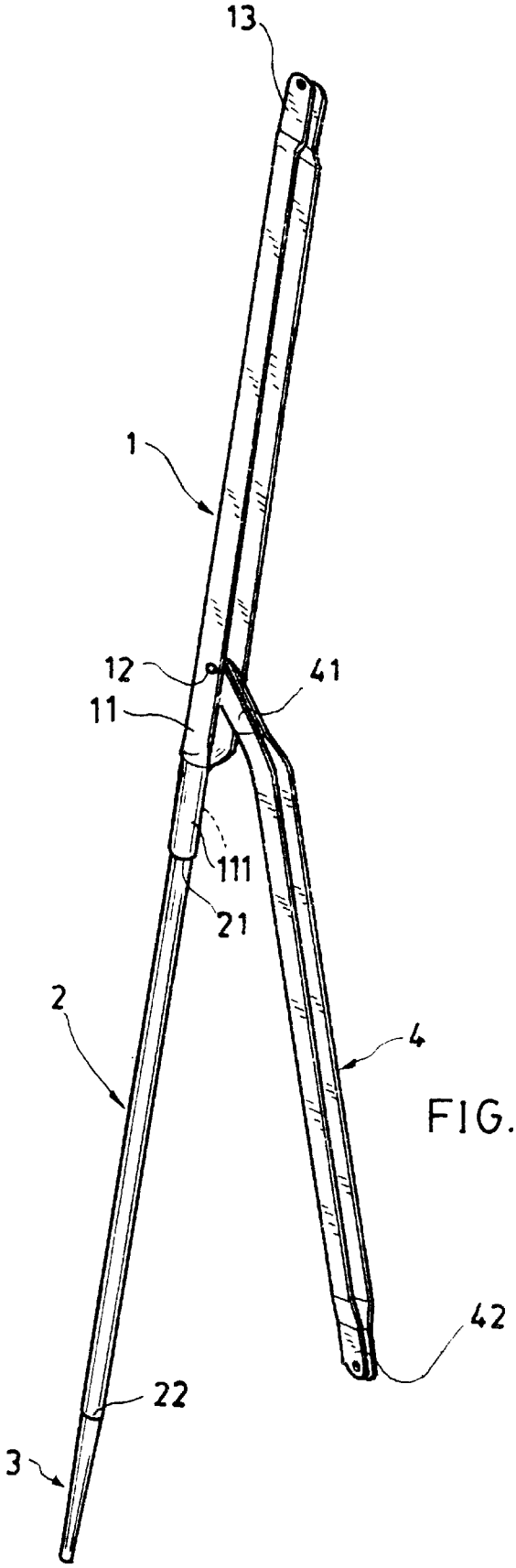
FIG. 10 shows still another preferred embodiment of the present invention.

As shown in FIGS. 10, 11, the outer portion 11 of the top rib 1 is formed with a pair of crimping lugs 111 for cladding the inner portion 21 of the outer rib 2 and the outer portion 11 of the top rib 1 is pivotally connected with the stretcher rib 4 by a pivot 12.

Figures 12, 13, 14:
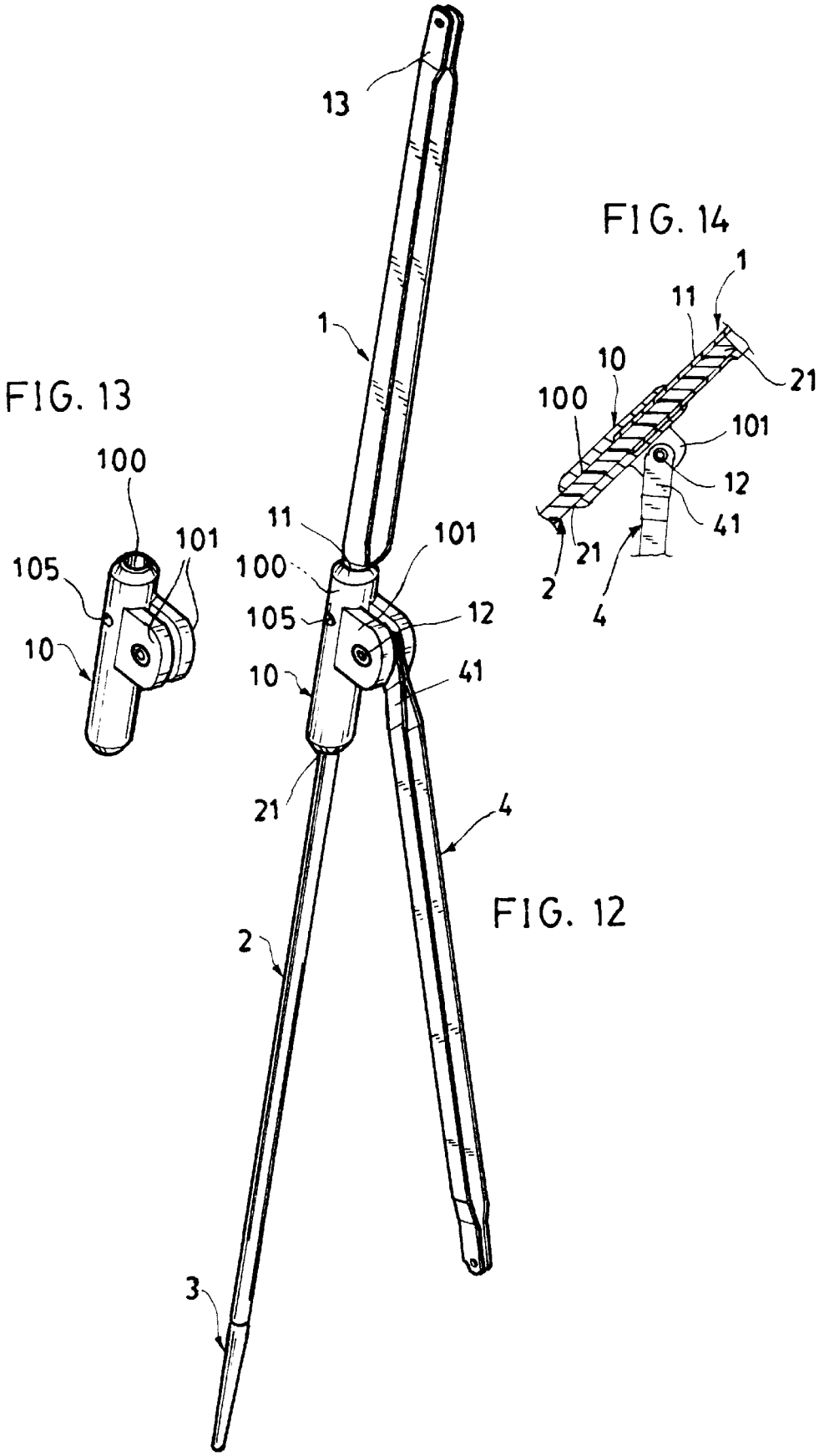
FIG. 12 shows further preferred embodiment of the present invention.
FIG. 13 is a perspective view of the joint member as shown in FIG. 12.
FIG. 14 is a partial sectional drawing of the rib assembly of FIG. 12.

As shown in FIGS. 12–14, the outer portion 11 of the top rib 1, after cladding the inner portion 21 of the outer rib 2 within the outer portion 11 of the top rib 1, is then clad by a joint member 10. The joint member 10 includes: a central through hole 100 for inserting the outer portion 11 of the top rib 1 into the central through hole 100, a pin or nail 105 transversely fixed through the joint member 10, the outer portion 11 of the top rib 1 and the inner portion 21 of the outer rib 2 for joining the joint member 10 together with the top rib 1 and the outer rib 2, and a pair of protrusion lugs 101 protruding downwardly from the joint member 10 for pivotally connecting the stretcher rib 4 by a pivot 12.

The joining between the relevant parts of the present invention may also be selected from rivetting, adhesive bonding and any other fastening methods, not limited in this invention.

The present invention may be modified without departing from the spirit and scope of this invention.

We claim:

1. A reinforced umbrella rib assembly comprising:

at least a top rib (1) having a cross section of U shape and made of materials selected from aluminum alloy, titanium alloy, and materials light in weight, and mechanically processed, manufactured and integrally formed with groove longitudinally recessed in the top rib (1);

at least an outer rib (2) secured to an outer portion (11) of the top rib (1), and a stretcher rib (4) pivotally connected to the top rib (1) adjacent to a junction between the top rib (1) and the outer rib (2), with said outer rib (2) made of composites and plastic materials selected from carbon fiber, fiberglass reinforced plastic, nylon, and mineral-fiber reinforced composites, having good mechanical strength for resisting bending, deformation and twisting and having good resilience for reinforcing the top rib (1) for forming a light-weight, resilient, and reinforcing umbrella rib assembly;

said top rib (1) having an outer portion (11) which is bifurcated to be two crimping lugs (111) for cladding an inner portion (21) of the outer rib (2), having a plurality of prongs (112) pressed inwardly from the top rib (1) into the inner portion (21) of the outer rib for firmly bonding the inner portion (21) of the outer rib (2) with the outer portion (11) of the top rib (1).

2. A reinforced umbrella rib assembly according to claim 1, wherein said outer portion (11) of said top rib (1) is formed with a pair of protrusion lugs (110) for pivotally connecting the stretcher rib (4) by pivot (12);

each said protrusion lug (110) tapered inwardly towards middle portion of said top rib (1) for forming a reinforcing wing portion (113) between the protrusion lug (110) and the top rib (1), having bottom extension (114) formed on a bottom of said top rib (1) as bent from one said reinforcing wing portion (113) for cladding an innermost end (211) of the outer rib (2).

3. A reinforced umbrella rib assembly comprising:

at least a top rib (1) having a cross section of U shape and made of materials selected from aluminum alloy, titanium alloy, and materials light in weight, and mechanically processed, manufactured and integrally formed with groove longitudinally recessed in the top rib (1);

at least an outer rib (2) secured to an outer portion (11) of the top rib (1), and a stretcher rib (4) pivotally connected to the top rib (1) adjacent to a junction between the top rib (1) and the outer rib (2), with said outer rib (2) made of composites and plastic materials selected from carbon fiber, fiberglass reinforced plastic, nylon, and mineral-fiber reinforced composites, having good mechanical strength for resisting bending, deformation and twisting and having good resilience for reinforcing the top rib (1) for forming a light-weight, resilient, and reinforcing umbrella rib assembly;

said top rib (1) having its outer portion (11) cladding the inner portion (21) of the outer rib (2), and a joint member (10) diposed around a junction between the top rib (1) and the outer rib (2), said joint member (10) including: a pair of protrusion lugs (101) for pivotally connecting an outer rib portion (41) of the stretcher rib (4) by a pivot (12), two pairs of crimping lugs (102, 103) disposed on opposite sides of the protrusion lugs (101) for cladding the outer portion (11) of the top rib (1) in which the inner portion (21) of the outer rib (2) has been clad in the outer portion (11) of the top rib (1), and a plurality of prongs (104) pressed inwardly from the joint member (10) into the outer portion (11) of the top rib (1) and the inner portion (21) of the outer rib (2) for joining the joint member (10), the outer rib (2), and the top rib (1).

* * * * *